US005776009A

United States Patent [19]

McAtee

[11] Patent Number: 5,776,009

[45] Date of Patent: Jul. 7, 1998

[54] MOMENTUM GENERATING GOLF CLUB

[76] Inventor: Joseph P. McAtee, 1613 Thistlewood Dr., Washington Crossing, Pa. 18977

[21] Appl. No.: 848,061

[22] Filed: Apr. 29, 1997

[51] Int. Cl.[6] ..... A63B 53/04

[52] U.S. Cl. ..... 473/333; 473/345

[58] Field of Search ..... 473/332, 333, 473/334, 335, 336, 337, 256, 324, 345, 346, 349

[56] References Cited

U.S. PATENT DOCUMENTS

| | | | |
|---|---|---|---|
| 690,940 | 1/1902 | Feiger | 473/333 |
| 1,318,325 | 10/1919 | Klin | 473/337 |
| 2,592,013 | 4/1952 | Curley | 473/333 |
| 3,589,731 | 6/1971 | Chancellor | 473/333 |
| 3,606,326 | 9/1971 | Soparks et al. | 473/300 |
| 4,461,481 | 7/1984 | Kim | 473/333 |
| 4,944,515 | 7/1990 | Shearer | 473/346 |
| 5,176,383 | 1/1993 | Duclos | 473/346 |
| 5,454,562 | 10/1995 | Sommer | 473/346 |

*Primary Examiner*—Sebastiano Passaniti
*Attorney, Agent, or Firm*—Michael I. Kroll

[57] ABSTRACT

A momentum generating golf club (10) comprising an elongated shaft (12). A resilient grip (14) is on a top end of the elongated shaft (12), while a club head body (16) is on a bottom end of the elongated shaft (12). The club head body (16) has a front striking face (18) and an internal chamber (20). A weight (22) is located within the internal chamber (20) for free movement therein. When a golfer takes a back swing the weight (22) will move backwards in the internal chamber (20), to produce inertia in the direction of the back swing of the club head body (16) to increase the extent of the back swing, thus allowing for a higher speed of the club head body (16) in the forward swing of the golf club (10), so as to hit a golf ball further on the front striking face (18).

16 Claims, 2 Drawing Sheets

MOMENTUM GENERATING GOLF CLUB

BACKGROUND OF THE INVENTION

1. Field of the Invention

The instant invention relates generally to weight distributing systems and more specifically it relates to a momentum generating golf club. The momentum generating golf club produces inertia in the direction of a back swing to increase the extent of the back swing, thus allowing for a fuller swing and a higher club head speed in the swing.

2. Description of the Prior Art

Numerous weight distributing systems have been provided in prior art. For example, U.S. Pat. Nos. 4,039,012 to Cook; 4,461,481 to Kim; 5,195,747 to Choy and 5,366,222 to Lee all are illustrative of such prior art. While these units may be suitable for the particular purpose to which they address, they would not be as suitable for the purposes of the present invention as heretofore described.

Cook, William H.

Non-Rebound Hammer

U.S. Pat. No. 4,039,012

A hammer having a hollow cylindrical head filled with recoil inhibiting pellets such as lead shot, and having its ends closed by metallic end caps each having an exterior impact surface. A handle-forming skeletal rod is centrally connected to the head. The head and rod are encased within a unitary resilient encasement leaving the two impact surfaces exposed.

Kim, Sunyong P.

Golf Club at the Driver Type

U.S. Pat. No. 4,461,481

A driver type of golf club is provided which includes a hollow metal head having integrally formed thereon a front striking face and a rear wall with interior flat portions, and a removable sole plate. A rod having a back plate integrally formed on the rear thereof has a cylindrical weight slideably mounted thereon. The rod is fixed in position within the hollow metal head with its back plate anchored against the interior flat portions on the rear wall thereof and with its front end held in a opening provided in a front plate anchored against the back of the striking face. At the instant of impact of the striking face of the head with a golf ball, the cylindrical weight is propelled to freely slide along the fixed rod to hit the front plate on the back of the striking face and therefore the ball, with a delayed impulse which creates an additional transfer of momentum to the ball, thereby increasing the distance that the ball travels.

Choy, Jung-Soo

Golf Club

U.S. Pat. No. 5,195,747

A golf club has an elongated shaft, a grip and a club head. The club head has an annular channel having a free moving weight therein which maintains the center of inertia of the club head in the same location regardless of the swing plane of the golf club.

Lee, Steven P.

Colf Club Head Having a Weight Distributing System

U.S. Pat. No. 5,366,222

A wood golf club head includes a golf club head cavity, a steel ball within the golf club head cavity and a permanent magnet plate attached to the back side of the club hea cavity. Upon hitting the golf ball, the steel ball moves an hits an inner sweet point corresponding to a sweet point o the front surface face of the golf club head. The struck bal will fly in a straight direction and in a longer distanc compared with an expected golf ball distance.

SUMMARY OF THE INVENTION

A primary object of the present invention is to provide a momentum generating golf club that will overcome th shortcomings of the prior art devices.

Another object is to provide a momentum generating gol club that will produce inertia in the direction of a back swin of the club head of the golf club to increase the extent of th back swing, thus allowing for a higher speed of the club hea in the swing of the golf club.

An additional object is to provide an momentum gener ating golf club in which a plurality of small dense meta spheres such as lead or steel shot, which are carried withi a forwardly angled cylindrical chamber within the club head filling twenty-five to seventy-five percent of the area of th cylindrical chamber, to assure that the spheres are forwar prior to the start of the back swing of the golf club. Thi chamber may also relate to a chamber that is non-cylindrica but shaped to provide a forwardly angled void to accomplis the same intent as the cylindrically shaped chamber depend ing on manufacturers processes.

A further object is to provide an momentum generatin golf club that is simple and easy to use.

A still further object is to provide an momentum gener ating golf club that is economical in cost to manufacture.

Further objects of the invention will appear as the descrip tion proceeds.

To the accomplishment of the above and related objects this invention may be embodied in the form illustrated in th accompanying drawings, attention being called to the fact however, that the drawings are illustrative only, and tha changes may be made in the specific construction illustrated and described within the scope of the appended claims, preserving the concept that dense spheres be located in a forwardly included chamber prior to the beginning of the back swing and having sufficient void space in the rear of the club head body, to accomplish the reaction of forcing an increase to the back swing distance through the inertia caused by the shifting of the mass of dense spheres.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figures 1, 2, 3:
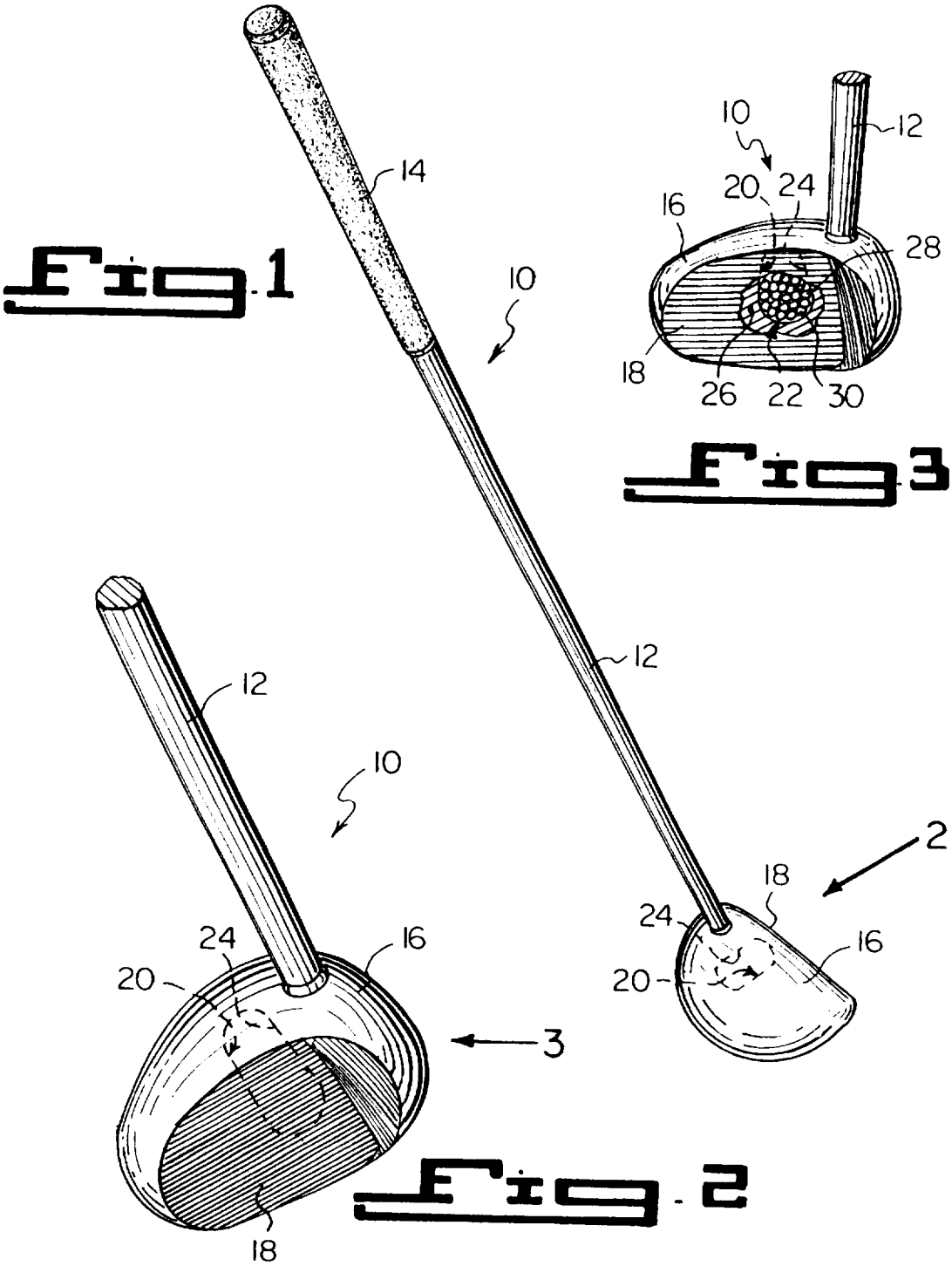
FIG. 1 is a rear perspective view of the instant invention, set in a typical "metal wood" golf club, in which the club may vary from a driver to a 7 wood.
FIG. 2 is an enlarged front perspective view taken in the direction of arrow 2 in FIG. 1, with the shaft broken away.
FIG. 3 is another front perspective view taken in the direction of arrow 3 in FIG. 2, with parts broken away an in section, showing the dense metal spheres therein, which are generally aligned with the primary striking location or "sweet spot".
Figure 4:
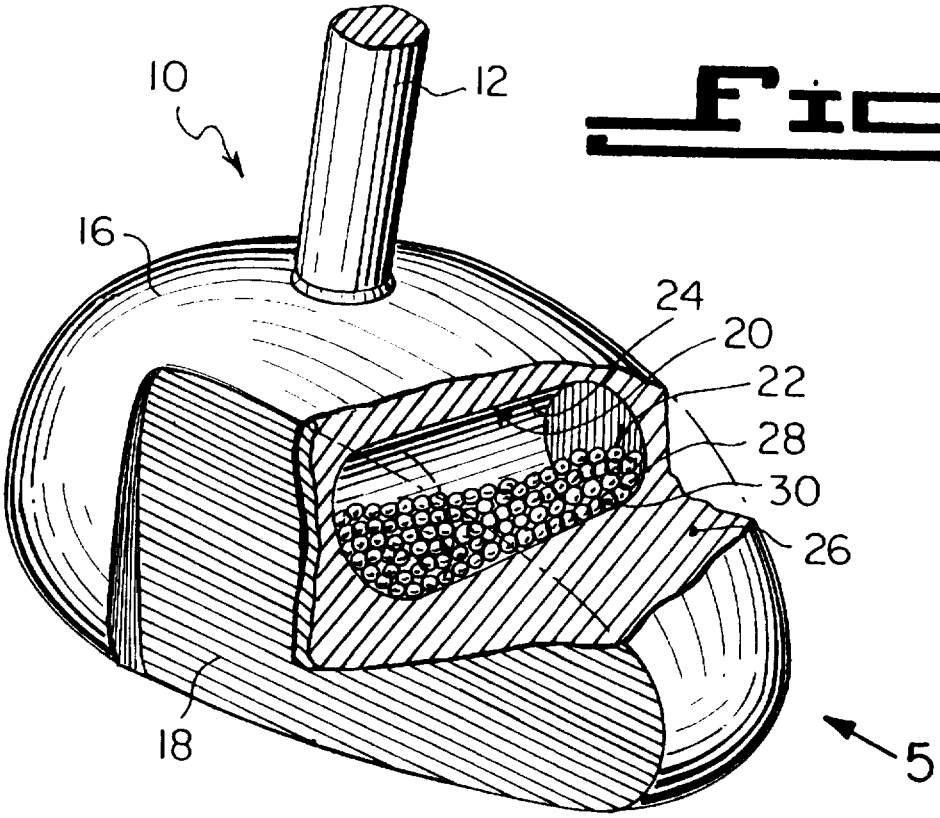
FIG. 4 is a front perspective view of a modification being a left handed golf club with parts broken away and in section.

Turning now descriptively to the drawings, in which similar reference characters denote similar elements throughout the several views, FIGS. 1 through 5 illustrate a momentum generating golf club 10 comprising an elongated shaft 12. A resilient grip 14 is on a top end of the elongated shaft 12, while a club head body 16 is on a bottom end of the elongated shaft 12. The club head body 16 has a front striking face 18 and an internal chamber 20. A weight 22 is located within the internal chamber 20 for free movement therein.

When a golfer takes a back swing the weight 22 will move backwards in the internal chamber 20, to produce inertia in the direction of the back swing of the club head body 16 to increase the extent of the back swing, thus allowing for a higher speed of the club head body 16 in the forward swing of the golf club 10, so as to hit a golf ball further on the front striking face 18.

Figure 5:
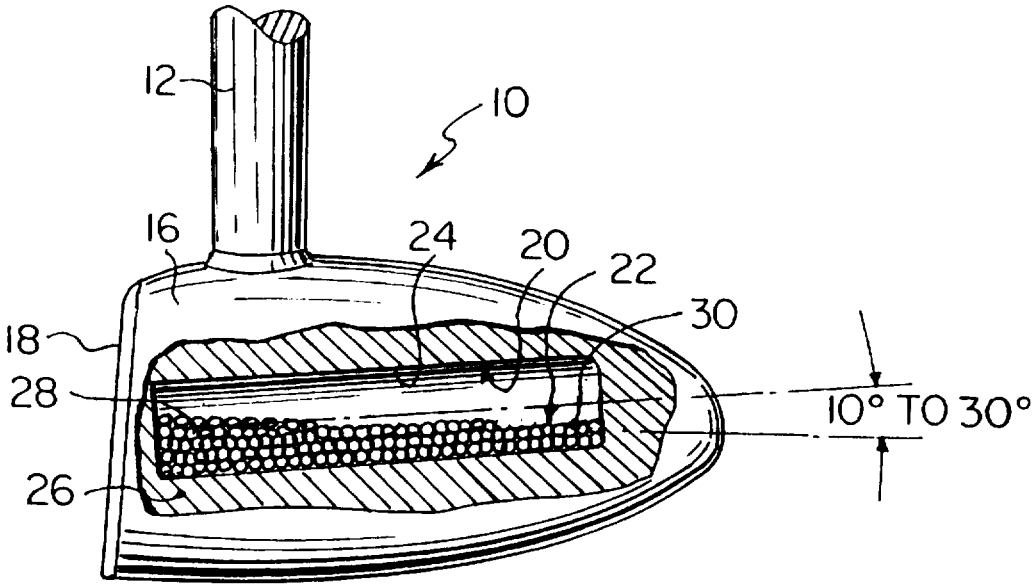
FIG. 5 is an end view taken in the direction of arrow 5 in FIG. 4, showing the forwardly angled cylindrical chamber with the small dense metal spheres therein.

As best seen in FIG. 5, the internal chamber 20 in the club head body 16 is carried at a forwardly angled longitudinal position with respect to the front striking face 18. This assures that the weight 22 is forward prior to the start of the back swing of the golf club 10.

The forwardly angled longitudinal position of the internal chamber 20 within the club head body 16 is typically but not limited to be between ten to thirty degrees, dependent upon the size of the club head body 16. The internal chamber 20 is an elongated symmetrical shaped void 24 formed within the club head body 16. It could be cylindrical shaped or other generally uniformed shaped voids which provide for the similar facilitation of the embodiment, allowing the weight 22 to freely be set in the forward position prior to the back swing and allowing free movement to the rear of the club head body 16 during the back swing.

The club head body 16 is typically referred to as a "metal wood", which could be a driver or another numbered metal wood" up to the number 7. The club head body 16 is fabricated out of a metal material 26. The weight 22 consists of a plurality of small spheres 28. The small spheres 28 occupy approximately between twenty-five to seventy-five percent of the area within the internal chamber 20. Each small sphere 28 is fabricated out of a dense heavy metal 30. The dense heavy metal 30 is lead, but could be steel or other compositions depending on availability, manufacture preference or various testing results.

The club head body 16 can also be configured for a left handed or right handed golfer, while still incorporating the features of the instant invention. The club head body 16, as shown in the drawings, is made out of a metal material 26, but other types of material, such as wood and plastic can be utilized in manufacturing the club head body 16 with the internal chamber 20 therein. The weight and number of the small spheres 28 may vary based on any United States Professional Golf Association weight restrictions, if any, and preference of various types of golfers, such as seniors, low handicappers, etc.

OPERATION OF THE INVENTION

To use the momentum generating golf club 10, the following steps should be taken by the golfer:

1. Place a golf ball upon a tee or as it sits on a fairway or other area of a golf course.
2. Grasp the resilient grip 14 on the top end of the elongated shaft 12 with both hands.
3. Take a back swing with the club head body 16.
4. The weight 22 will move backwards in the internal chamber 20 of the club head body 16, to increase the extent of the back swing.
5. In the forward swing of the club head body 16 a higher speed will be achieved.
6. The front striking face 18 on the club head body 16 will now hit the golf ball further from the point of contact due to the club head body speed.

LIST OF REFERENCE NUMBERS

10 momentum generating golf club
12 elongated shaft of 10
14 resilient grip of 10 on 12
16 club head body of 10 on 12
18 front striking face on 16
20 internal chamber of 16
22 weight of 10 in 20
24 cylindrical shaped void for 20
26 metal material for 16
28 small sphere of 22
30 dense heavy metal for 28

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by letters patent is set forth in the appended claims:

1. A momentum generating golf club comprising:

a) an elongated shaft;

b) a resilient grip on a top end of said elongated shaft;

c) a club head body on a bottom end of said elongated shaft, said club head body having a front striking face and an internal chamber; and d) a weight located within said internal chamber for free movement therein, whereby when a golfer takes a back swing said weight will move backwards in said internal chamber, to produce inertia in the direction of the back swing of said club head body to increase the extent of the back swing, thus allowing for a higher speed of said club head body in the forward swing of said golf club, so as to hit a golf ball further on said front striking face, and wherein said internal chamber in said club head body is carried at a forwardly angled longitudinal position with respect to said front striking internal chamber being angled toward a lower extent of said front striking face when said head is viewed in end view in a normal address position, so as to assure that said weight is forward prior to the start of the back swing of said golf club.

2. A momentum generating golf club as recited in claim 1, wherein said forwardly angled longitudinal position of said internal chamber within said club head body is typically but not limited to be between ten to thirty degrees, dependent upon the size of said club head body.

3. A momentum generating golf club as recited in claim 2, wherein said internal chamber is an elongated symmetrical shaped void formed within said club head body.

4. A momentum generating golf club as recited in claim 1, wherein said club head body is a "metal wood".

5. A momentum generating golf club as recited in claim 1, wherein said club head body is fabricated out of a metal material.

6. A momentum generating golf club as recited in claim 1, wherein said weight includes a plurality of small spheres.

7. A momentum generating golf club as recited in claim 6, wherein said small spheres occupy approximately between twenty-five to seventy-five percent of the area within said internal chamber.

8. A momentum generating golf club as recited in claim 6, wherein each said small sphere is fabricated out of a dense heavy metal.

9. A momentum generating golf club as recited in claim 8, wherein said dense heavy metal is selected from a group consisting of lead and steel.

10. A momentum generating golf club as recited in claim 1, wherein said internal chamber is an elongated symmetrical shaped void formed within said club head body.

11. A momentum generating golf club as recited in claim 10, wherein said club head body is a "metal wood".

12. A momentum generating golf club as recited in claim 11, wherein said club head body is fabricated out of a metal material.

13. A momentum generating golf club as recited in claim 12, wherein said weight includes a plurality of small spheres.

14. A momentum generating golf club as recited in claim 13, wherein said small spheres occupy approximately between twenty-five to seventy-five percent of the area within said internal chamber.

15. A momentum generating golf club as recited in claim 14, wherein each said small sphere is fabricated out of a dense heavy metal.

16. A momentum generating golf club as recited in claim 15, wherein said dense heavy metal is selected from a group consisting of lead and steel.

* * * * *